US006068708A

United States Patent [19]

Lauer et al.

[11] Patent Number: 6,068,708

[45] Date of Patent: May 30, 2000

[54] PROCESS OF MAKING ELECTRICAL STEELS HAVING GOOD CLEANLINESS AND MAGNETIC PROPERTIES

[75] Inventors: Barry A. Lauer, Macedonia; Gerald F. Beatty, Solon; Jeffrey P. Anderson, Macedonia, all of Ohio

[73] Assignee: LTV Steel Company, Inc., N.J.

[21] Appl. No.: 09/038,172

[22] Filed: Mar. 10, 1998

[51] Int. Cl.[7] ..... C21D 8/12

[52] U.S. Cl. ..... 148/111; 148/112; 148/113

[58] Field of Search ..... 148/100, 110, 148/111, 112, 113, 120

[56] References Cited

U.S. PATENT DOCUMENTS

| | | |
|---|---|---|
| 2,067,036 | 1/1937 | Wimmer . |
| 2,303,343 | 12/1942 | Engel et al. . |
| 2,351,922 | 6/1944 | Burgwin . |
| 2,412,041 | 12/1946 | Gifford et al. . |
| 2,986,485 | 5/1961 | Fitz et al. . |
| 3,130,088 | 4/1964 | Cook . |
| 3,188,250 | 6/1965 | Holbein et al. . |
| 3,212,942 | 10/1965 | Takahashi . |
| 3,297,434 | 1/1967 | Littmann . |
| 3,415,696 | 12/1968 | Gimigliano . |
| 3,620,856 | 11/1971 | Hiraoka . |
| 3,770,517 | 11/1973 | Gray et al. . |
| 3,873,380 | 3/1975 | Malagari, Jr. . |
| 3,892,604 | 7/1975 | Thornburg et al. . |
| 3,895,974 | 7/1975 | Watanabe et al. . |
| 3,923,560 | 12/1975 | Regitz . |
| 3,932,237 | 1/1976 | Irie et al. . |
| 3,940,299 | 2/1976 | Goto et al. . |
| 3,954,521 | 5/1976 | Malagari et al. . |
| 4,066,479 | 1/1978 | Shimoyama et al. . |
| 4,123,298 | 10/1978 | Kohler et al. . |
| 4,204,890 | 5/1980 | Irie et al. . |
| 4,306,922 | 12/1981 | Coombs et al. . |
| 4,319,936 | 3/1982 | Dahlstrom et al. . |
| 4,337,101 | 6/1982 | Malagari, Jr. . |
| 4,390,378 | 6/1983 | Rastogi . |
| 4,666,534 | 5/1987 | Miyoshi et al. . |
| 4,772,341 | 9/1988 | Rastogi et al. . |
| 4,979,997 | 12/1990 | Kobayashi et al. . |

(List continued on next page.)

FOREIGN PATENT DOCUMENTS

| | | |
|---|---|---|
| 1438853 | 4/1966 | France . |
| 1550182 | 12/1968 | France . |
| 63-47332 | 2/1988 | Japan . |
| 63-210237 | 8/1988 | Japan . |
| 1-198428 | 8/1989 | Japan . |
| 4280921 | 6/1992 | Japan . |

OTHER PUBLICATIONS

EPO Search Report for Application No. EP 95 30 2553, Aug. 14, 1995.

Chen S. Lee, "Effect of Hot Rolling Conditions on Microstructure and Properties of 1% Silicon Steel", pp. 1–16 (1996).

Dunkle et al., "Closing The Gap With Electrical Lamination Steels", ASM's Material Week, pp. 1–14. Oct. (1986).

Hansen, M., Constitution of Binary 2nd Edition, McGraw Hill Book Company, Inc., 1958, p. 665.

*Primary Examiner*—Deborah Yee

*Attorney, Agent, or Firm*—Watts, Hoffmann, Fisher & Heinke Co., L.P.A.

[57] ABSTRACT

A method of making electrical steel strip characterized by low core loss, high permeability and good cleanliness includes producing a slab having a composition consisting essentially of (% by weight): up to 0.02 C, 0.20–1.35 Si, 0.10–0.45 Al, 0.10–1.0 Mn, up to 0.015 S, up to 0.006 N, up to 0.07 Sb, up to 0.12 Sn, and the balance being substantially iron. The slab is hot rolled into a strip with a finishing temperature in the ferrite region. The strip is coiled at a temperature less than 1200° F. and, preferably, less than 1000° F. The strip which has not been subjected to an annealing operation after the coiling is subjected to cold rolling. The strip is then batch annealed and temper rolled.

24 Claims, 3 Drawing Sheets

U.S. PATENT DOCUMENTS 5,009,726 4/1991 Nishimoto et al. .
5,013,372 5/1991 Honda et al. .
5,045,129 9/1991 Barisoni .
5,049,205 9/1991 Takahashi et al. .
5,062,905 11/1991 Tomita et al. .
5,096,510 3/1992 Schoen et al. .
5,102,478 4/1992 Hosoya et al. .
5,108,521 4/1992 Hosoya et al. .
5,143,561 9/1992 Kitamura et al. .
5,145,533 9/1992 Yoshitomi et al. .
5,609,696 3/1997 Lauer et al. ..... 148/111

PROCESS OF MAKING ELECTRICAL STEELS HAVING GOOD CLEANLINESS AND MAGNETIC PROPERTIES

BACKGROUND OF THE INVENTION

Desired electrical properties of steels used for making motor laminations are low core loss and high permeability. Those steels which are stress relief annealed after punching also should have properties which minimize distortion, warpage and delamination during the annealing of the lamination stacks.

Continuously annealed, silicon steels are conventionally used for motors, transformers, generators and similar electrical products. Continuously annealed silicon steels can be processed by techniques well known in the art to obtain low core loss and high permeability. Since these steels are substantially free of strain, they can be used in the as-punched condition (in which the steel as sold is commonly referred to as fully processed) or if better magnetic properties are desired the steel can be finally annealed by the electrical apparatus manufacturer after punching of the laminations (in which case the steel as sold is commonly referred to as semi-processed) with little danger of delamination, warpage, or distortion. A disadvantage of this practice is that the electrical steel sheet manufacturer is required to have a continuous annealing facility.

In order to avoid a continuous annealing operation, practices have been developed to produce cold rolled motor lamination steel by standard cold rolled sheet processing including batch annealing followed by temper rolling. In order to obtain the desired magnetic properties of high permeability and low core loss, it is common to temper roll the steel with a heavy reduction in thickness on the order of 7%. Electrical steels processed by batch annealing and heavy temper rolling followed by a final stress relief anneal after the punching operations develop acceptable core loss and permeability.

Fully-processed electrical steels are used by customers in the as-punched/stamped condition without a subsequent annealing operation being required. Standard cold-rolled electrical steels are unsuitable for most fully-processed applications due to strain remaining in the material. Fully processed materials are produced utilizing continuous anneal lines since no additional strain is required to provide acceptable flatness. Batch annealed materials, however, do not have acceptable flatness and require some strain simply to provide a flat product. This strain is usually provided by conventional temper rolling.

Conventional hot rolling practices for cold rolled motor lamination electrical steels use high finishing temperatures in the austenite region. While a hot band annealing step may be omitted, high coiling temperatures of, for example, about 1400° F., are used to promote "self annealing" of the generated hot bands. This process is believed to produce optimal magnetic properties. Processes employing austenite hot roll finishing temperatures result in poorer magnetic properties, particularly permeability, as coiling temperatures are decreased. It is believed that in such processes coiling should be carried out at temperatures of at least 1200° F. to avoid degradation of magnetic properties.

Hot band annealing is used in such methods to improve magnetic properties of the steel. However, despite any improvements in magnetic properties, the hot band annealing process is undesirable in that it is an extra step, expensive equipment for annealing at relatively high temperatures is required, and the hot band anneal process lasts several days if batch type facilities are used. As a result, the hot band annealing step increases the cost of the steel.

Cleanliness of the steel strip is an increasing concern of some customers of motor lamination steel. Fine iron particles on the surface of the strip can create problems for some customers. One problem is that the iron fines may come off the strip and build up in roller leveling equipment used to remove coil set. This requires cleaning the equipment.

Another problem occurs during stamping. Indexing rolls cause the strip to be fed precise distances into dies for successive punching of shapes. The distance the strip is indexed is determined by the arc of the indexing rolls. The iron fines may adhere to the indexing rolls and thus, change their diameter. This changes the feed length and causes the strip to be indexed by an improper amount, which can require the process to be stopped for cleaning of the indexing rolls. Yet another problem is that the dies may require cleaning when a build up on the dies prevents proper flow of the material. Of course, stopping the process is undesirable in that it decreases the productivity of stamping and results in the expense of cleaning the equipment.

SUMMARY OF THE INVENTION

The present invention relates generally to the production of electrical steels, and more specifically to cold rolled, batch annealed and temper rolled motor lamination steels having good cleanliness as well as unexpectedly good low core loss and high permeability.

The present invention is generally directed to a method of making electrical steel strip characterized by low core loss and high permeability comprising the steps of:

producing a slab having a composition consisting essentially of (% by weight):
- C: up to 0.02
- Si: 0.20–1.35
- Al: 0.10–0.45
- Mn: 0.10–1.0
- S: up to 0.015
- N: up to 0.006
- Sb: up to 0.07
- Sn: up to 0.12, and
- the balance being substantially iron, hot rolling the slab into a strip with a finishing temperature in the ferrite region, coiling the strip at a temperature less than 1200° F., cold rolling the strip which has not been subjected to an annealing operation after the coiling, batch annealing the strip, and temper rolling to reduce the thickness of the strip.

A preferred embodiment of the present invention is directed to a method of making electrical steel strip characterized by low core loss and high permeability comprising the steps of:

producing a slab having a composition consisting essentially of (% by weight):
- C: up to 0.02
- Si: 0.20–1.35
- Al: 0.10–0.45
- Mn: 0.10–1.0
- S: up to 0.015
- N: up to 0.006
- Sb: up to 0.07
- Sn: up to 0.12, and
- the balance being substantially iron, hot rolling the slab into a strip with a finishing temperature in the ferrite region, coiling the strip at a temperature not greater than about 1000° F., cold rolling the strip which has not been subjected to an annealing operation after the coiling, batch annealing the strip, temper rolling to reduce the thickness of the strip by an amount ranging from about 3% to about 10%, and final annealing.

Specific features of the present invention include the step of coiling the strip at a temperature not greater than 1050° F. and, more preferably, coiling the strip at a temperature not greater than 1000° F. The coiling temperature is selected to result in good permeability and low core loss as well as to produce a strip cleanliness characterized by at least about 70.0% light transmission through tape and, even more preferably, a strip cleanliness of at least about 74.0% light transmission through tape. The good cleanliness of the steel strip made according to the present invention is a result of processing conditions which decrease the iron fines which are present on or are detachable from the product.

Ferrite hot roll finishing temperatures and low coiling temperatures are advantageously used and, while avoiding the costly step of hot band annealing, unexpectedly achieve high permeability and low core loss. This is advantageous in that less time and energy is utilized to heat the steel to the ferrite is phase and for suitable coiling.

Other objects and a fuller understanding of the invention will be had from the accompanying drawings and the following description of preferred embodiments.

DESCRIPTION OF PREFERRED EMBODIMENTS

The present invention is generally directed to a method of making electrical steel strip characterized by low core loss and high permeability. The method comprises hot rolling a slab of a particular composition into a strip at a finishing temperature in the ferrite region. The strip is then coiled at a temperature less than 1200° F. Without subjecting the strip to an annealing operation, the strip is then cold rolled after coiling. The strip is then batch annealed and temper rolled.

Achieving a hot roll finishing temperature in the ferrite region is an important aspect of the present invention. The terms "ferrite finishing temperature" as used herein refer to temperature of steel in the finishing stands of the hot rolling mill at which the steel material is substantially completely in the ferrite phase. This is contrasted with a two-phase region that occurs at higher temperatures. In the two-phase region the steel exhibits both the austenite and ferrite phases. The austenite phase is formed at higher temperatures above the two-phase region. The range of temperatures in which a material will be in the ferrite phase is dependent upon factors including the composition of the material, for example, carbon level and alloy content.

FIGS. 1–6 shows the effects of composition on phase transition temperatures as determined by mill loads. Two important inflexion points are shown in these figures. The first occurs as the hot rolling finishing temperature is decreased. Upon reaching the first inflection point, rapidly increasing mill loads suddenly begin to decrease. This inflexion point signifies the beginning of the transition from the austenite phase to the two phase region—a mixture of the austenite phase and the ferrite phase. Mill loads drop due to the increasing amount of the ferrite phase, since the ferrite phase has an inherently lower strength than the austenite phase.

A second inflexion point is reached as the hot roll finishing temperature is further decreased. Mill loads continue to drop in the two-phase region as the material gradually becomes more ferritic and hence, less austenitic. At finishing temperatures below the second inflexion point the steel is considered to be fully ferritic, assuming the slab/hot band being hot rolled is uniform in temperature. The slab edges and portions which were in contact with the "skids" or "runners" upon which the slabs rest in the reheat furnace prior to hot rolling, would he slightly lower in temperature and thus, fully ferritic. As the finishing temperature is decreased further, the mill loads begin to rise again although at considerably lower levels than in the austenite hot rolled phase. The location of the phase transition temperature of the second inflexion point is of primary concern when seeking to hot roll in the ferrite region.

Figure 1:
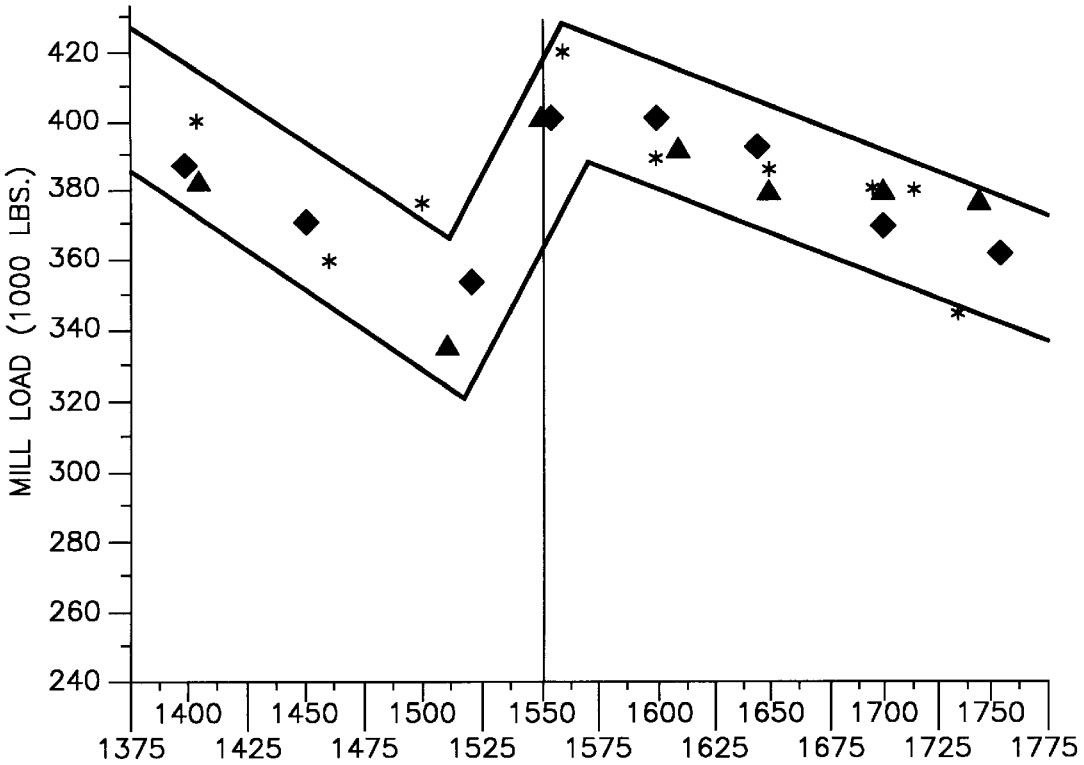
FIGS. 1–6 show mill loads as a function of hot roll finishing temperatures.
Figure 2:
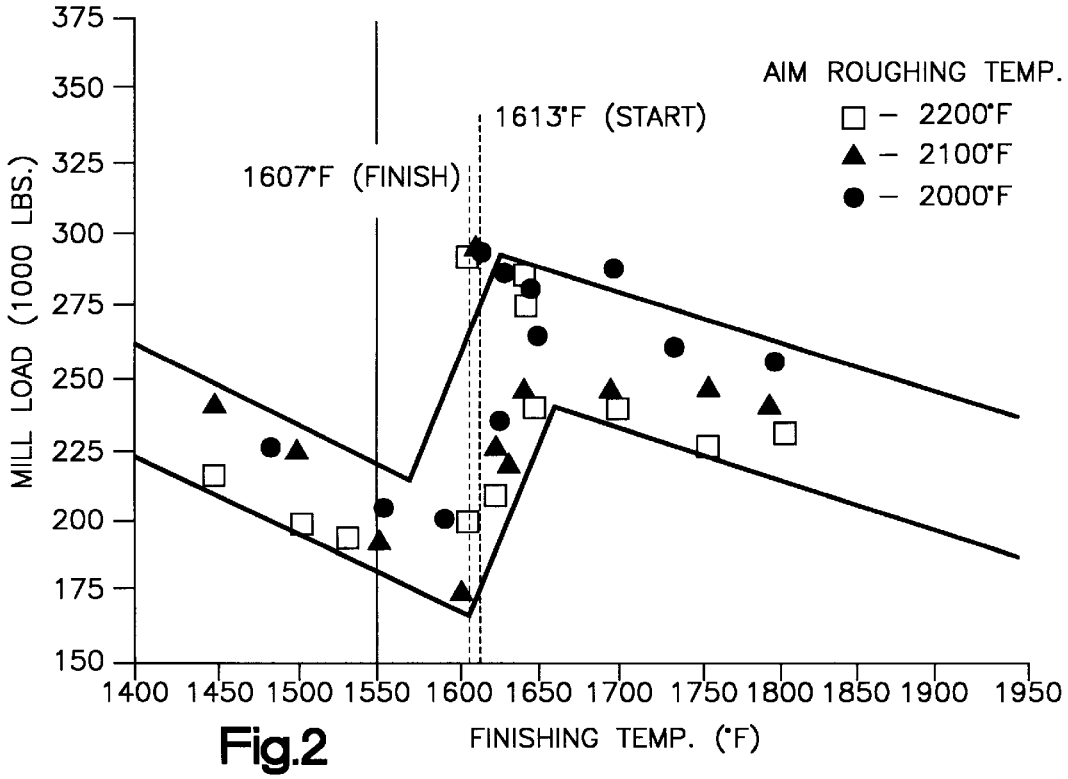

FIGS. 1 and 2 show the behavior of essentially nonalloyed materials (0.15 Mn, 0.003 Si) that differ significantly only in carbon content. The steel of FIG. 1 had 0.04% carbon while the steel of FIG. 2 had 0.003% carbon, all amounts herein being in percent by weight. An arbitrary vertical line is drawn at 1550° F. as a reference on all the figures. As a result only of differences in carbon content, the 0.04% carbon material was almost totally austenitic at 1550° F. whereas the 0.003% material was almost completely ferritic at that temperature.

Figure 3:
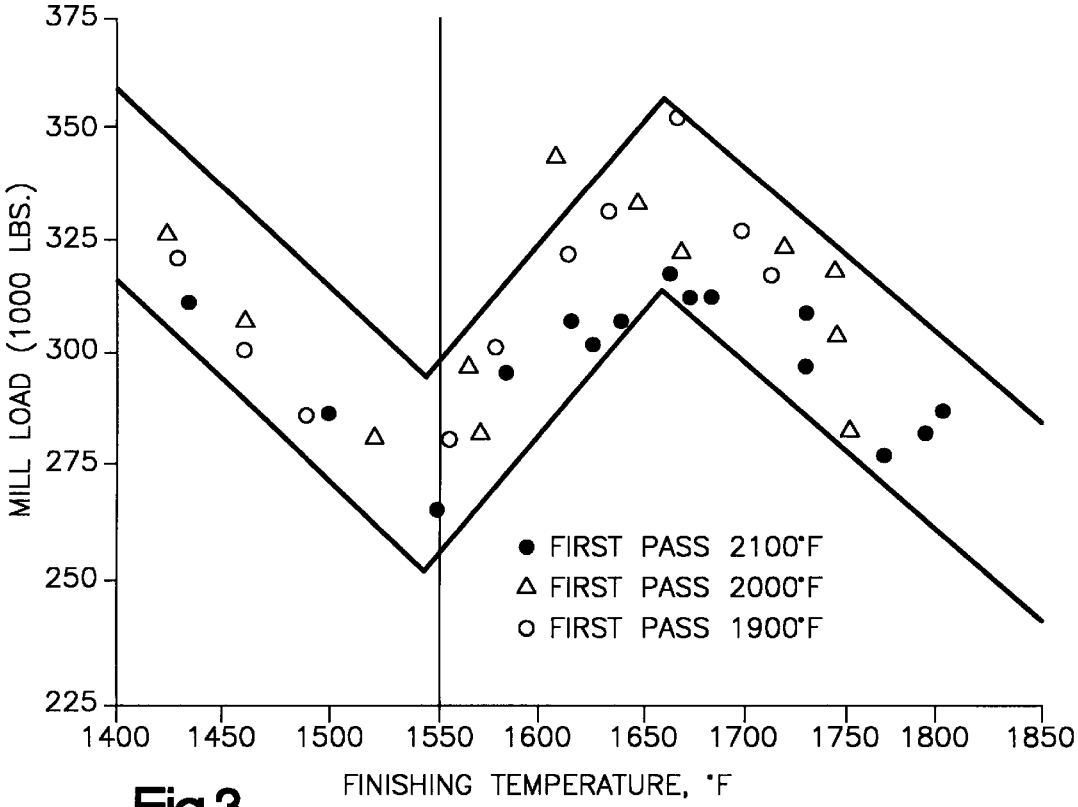
Figure 4:
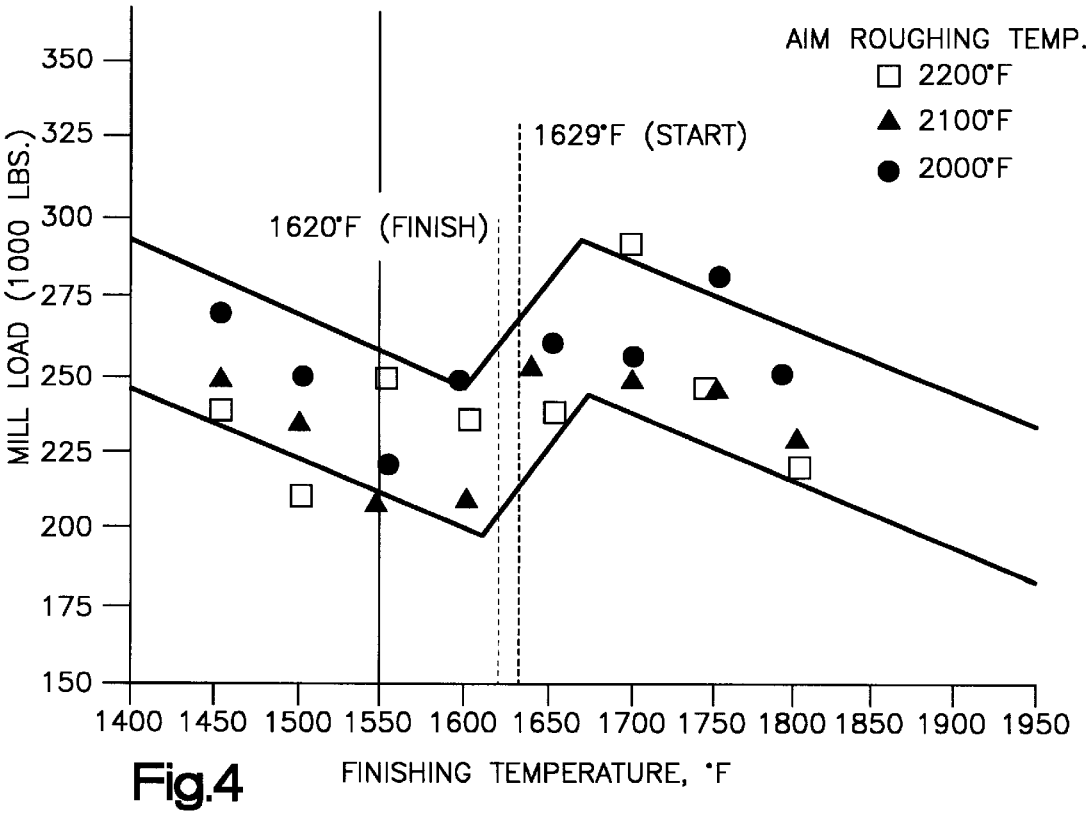

FIGS. 3 and 4 show the same trend in materials with added silicon and aluminum, differing substantially only in carbon content. The steel of FIG. 3 had 0.02% C, 0.35% Si and 0.25% Al while the steel of FIG. 4 had 0.005% C, 0.30 Si and 0.25% Al. Again, the reduction in carbon tends to increase the phase transition temperature.

A comparison of FIGS. 2 and 4 illustrates that increasing the alloy content increases the phase transition temperature. While the carbon content of the steel of FIGS. 2 and 4 was similar (0.003 and 0.005%, respectively), the steel of FIG. 2 was essentially nonalloyed whereas the steel of FIG. 4 had 0.30 Si and 0.25% Al.

Figure 5:
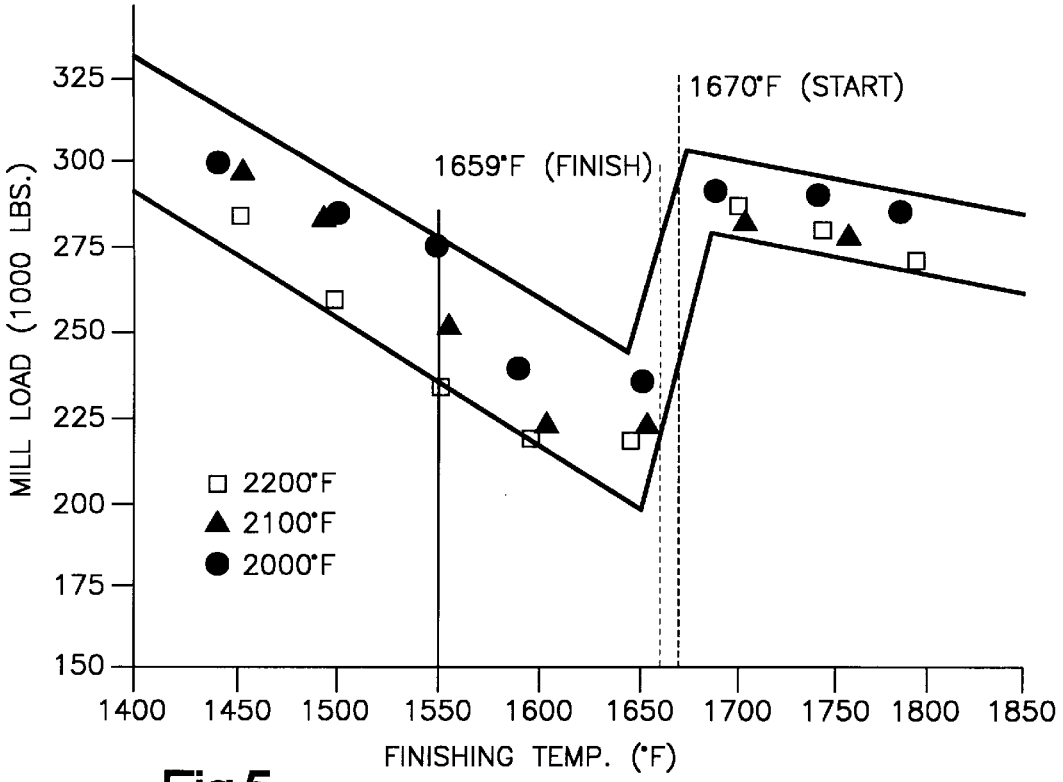
Figure 6:
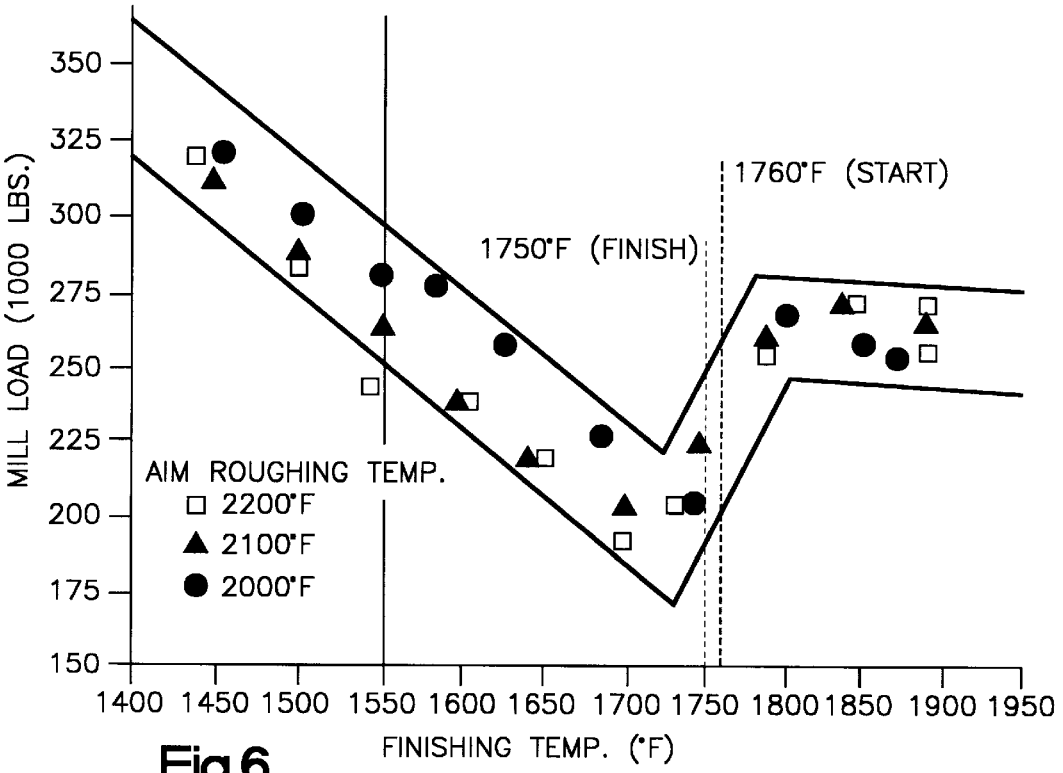

The steel of FIGS. 5 and 6 contained higher alloy levels. The steel of FIG. 5 had 0.007% C, 0.74% Si and 0.25% Al. The steel of FIG. 6 had 0.003% C, 1.25% Si and 0.25% Al. Increasing the silicon content raised the transition temperature substantially. The foregoing illustrates that, for example, the second inflexion point (the ferrite to ferrite-austenite transition temperature) is the lowest using higher amounts of carbon and lower amounts of alloy, and is raised when the amount of carbon is decreased or the amount of alloy is increased.

Hot rolling in the two-phase region is highly unstable. Since hot rolling is carried out at high speeds, hot rolling at temperatures at which the steel is in the two-phase region causes a conflict in the mill equipment attempting to control hot reduction to meet thickness specifications while trying to cope with rapidly changing loads on the rolls. Complicating this is any inherent nonuniformity in temperature within the hot band/slab being rolled.

In addition to the problem of thickness nonuniformity, another more severe consequence of hot rolling in the two-phase region is the occurrence of mill wrecks. In this catastrophic situation, hot steel charges forward at high speed into a stand at which all forward motion is blocked, resulting in a massive pile-up of very hot, twisted steel. Therefore, hot rolling at finishing temperatures in the two phase region is avoided.

The steel composition of the present invention consists essentially of: up to 0.01% C, 0.20–1.35% Si, 0.10–0.45% Al, 0.10–1.0% Mn, up to 0.015% S, up to 0.006% N, up to 0.07% Sb, and up to 0.12% Sn. The balance of the composition is substantially iron, i.e., iron and unintentional impurities. More specific compositions include less than 0.005% C, 0.25–1.0% Si, 0.20–0.35% Al, and less than 0.004% N. Suitable amounts of Sb are from 0.01–0.07% by weight, and, more preferably, from 0.03–0.05%. Less preferably, Sn may be used in a typical range of from 0.02–0.12%.

In accordance with the invention in this and in other embodiments, semi-processed steels may have a composition including a carbon content slightly higher than up to 0.01%. For example, a carbon content of up to 0.02% may be used.

In carrying out the process of the invention, a steel slab of the indicated composition is reheated at a temperature ranging from about 2100–2300° F. For example, the reheating temperature was carried out at a 2250° F. aim temperature and a 2300° F. maximum soak temperature.

The steel slab of the indicated composition is hot rolled into a strip with a finishing temperature in the ferrite region, coiled and optionally pickled.

The strip is coiled at a temperature less than 1200° F., and preferably, not greater than 1050° F. Even more preferably, the strip is coiled at a temperature not greater than 1000° F. These coiling temperatures result in improved cleanliness of the strip as well as unexpectedly good magnetic properties.

No hot band annealing is utilized in the present method. Following coiling, the strip is cold rolled and batch annealed. The cold rolling reduction in thickness of the strip typically ranges from 70–80%. The batch anneal operation is carried out in a conventional manner at a coil temperature ranging from 1050°–1350° F.

The batch annealed strip is temper rolled. Temper rolling is preferably carried out to reduce the thickness of the strip by an amount ranging from about 3 to about 10% and, more preferably, by an amount ranging from about 5 to about 8%.

For good magnetic property response particularly at 1.5 Tesla and above (i.e., an induction of 15 kiloGauss and above), finish hot rolling in the ferrite region as determined by the product composition combined with reduced coiling temperature results in improved magnetic properties, specifically permeability, compared to that which is obtained by traditional austenite practices. In addition, the lower coiling temperatures provide increased cleanliness.

EXAMPLE 1

A slab of steel had the following nominal composition (% by weight): 0.004% C, 0.5% Mn, 0.010% P, 0.006% S, 0.65% Si, 0.30% Al and 0.04% Sb. The slab was hot rolled into a strip with a finishing temperature of 1530° F. in the ferrite region or at a finishing temperature of 1720° F. in the austenite region. The strip was coiled at the temperatures shown in Table 1 and then pickled. The hot band annealing step was omitted. The material was then tandem rolled, followed by batch annealing and temper rolling to reduce the thickness of the strip by 6–8%. The reported magnetic properties were obtained for a semi-processed product, following a final stress relief anneal. The data in all tables herein were generated from testing a plurality of strips. The magnetic properties of Tables 1 and 2 were obtained at an induction of 1.5 Tesla and were measured using Epstein testing.

TABLE 1

| Ex. | Hot Roll Finish Temp. (° F.) | Coiling Temp. | Core Loss (Watts/lb) | Perm. (G/Oe) | Strip Thickness (in.) |
|---|---|---|---|---|---|
| A | 1530 | 1200 | 1.99 | 2547 | 0.0187 |
| B | 1720 | 142O | 2.03 | 2264 | 0.0184 |

Surprisingly, according to the present invention additional improvements in cleanliness were obtained using the ferrite hot rolling practice and lower coiling temperature. Despite a significant drop in coiling temperature and thus, less possibility for "self annealing," magnetic properties of the steel of Example A were equivalent to or even superior than the steel of Example B which was hot rolled according to the austenite practice at substantially higher coiling temperatures.

TABLE 2

| Ex. | Hot Roll Finish Temp. | Coiling Temp. (° F.) | Core Loss (Watts/lb) | Perm. (G/Oe) | Strip Thickness (in.) |
|---|---|---|---|---|---|
| C | 1530 | 1000 | 2.32 | 2545 | 0.0219 |
| D | 1720 | 1300 | 2.26 | 2487 | 0.0219 |

According to the ferrite hot rolling practice of the present invention, degradation of magnetic properties due to lower coiling temperatures does not occur as it does in the austenite hot roll finishing practice. Table 2 shows that even when coiling at the very low temperature of 1000° F., magnetic properties were comparable to that achieved using much higher coiling temperatures.

EXAMPLE 2

Electrical steel was made according to the process of the present invention by producing a slab of steel with the nominal compositions given in Table 3, hot rolling the slab into a strip at the finishing temperatures reported in Table 4, pickling, no hot band annealing, coiling at the temperatures reported in Table 4, batch annealing, and temper rolling to reduce the thickness of the strip by an amount ranging from about 6 to 8%.

The present invention also results in very good strip cleanliness as shown in the following Table 4. The cleanliness data of Table 4 were obtained by using pieces of transparent tape which were placed against a surface of the steel strip after temper rolling or a final operation (e.g., a slitter line). The tape with any adhered particles such as iron fines are then attached to a plain white paper surface. For example, typical iron fines may have a size of about 0.5 mils. A light transmission measuring device such as a Photovolt 577 Reflectance and Gloss Meter is first standardized against a piece of clear tape attached to a clean piece of paper (using the same type and brand of tape and paper). This represents 100% reflectance. Any iron fines or carbonaceous material on the strip causes the tape to become darkened and less reflective and yields a lower percentage transmission in the Tape Test as measured by the above unit.

Care must be taken to avoid contamination of the tape surface. Tape Tests are taken at intervals across the strip width to detect cleanliness differences at different locations. Therefore, there may be differences in Tape Test values across as well as through a coil of strip. Although the tape was placed onto the strip by hand, variation in measurement may be minimized such as by using a device which would apply the same pressure to the tape onto the steel each time. Since all coils are evaluated similarly, the Tape Test provides a useful indicator of relative strip surface cleanliness. Cleanliness levels above 70% transmission correspond to a very clean product whereas below 65% transmission strip cleanliness begins to present problems for some customers.

TABLE 3

| Ex | C | Mn | Ph | S | Si | Al | Sb |
|---|---|---|---|---|---|---|---|
| E–H | .012–.024 | .40–.70 | .20 max | .018 max | .30–.45 | .200–.350 | .030–.040 |
| I–N | .005 max | .40–.60 | .020 max | .012 max | .55–.75 | .250–.40 | .035–.045 |
| O, P | .012–.024 | .40–.70 | .020 max | .018 max | .30–.45 | .200–.350 | .030–.040 |
| Q, R | .005 max | .40–.70 | .025 max | .020 max | .25–.35 | .010–.060 | .010–.019 |
| S, T | .005 max | .40–.70 | .020 max | .018 max | .30–.45 | .200–.350 | .030–.040 |

TABLE 4

| Ex. | Hot Band Anneal | Finishing Temp (° F.) | Coiling Temp (° F.) | Group I % Trans. | Group II % Trans. |
|---|---|---|---|---|---|
| E | None | 1680 | 1050 | 71.39 | 71.62 |
| F | None | 1475 | 1000 | 77.53 | 77.16 |
| G | None | 1475 | 1200 | 76.16 | 75.71 |
| H | PBA | 1680 | 1050 | 73.85 | 73.70 |
| I | None | 1720 | 1420 | 70.53 | 72.41 |
| J | None | 1680 | 1050 | 73.67 | 74.23 |
| K | None | 1530 | 1000 | 75.59 | 75.45 |
| L | None | 1530 | 1200 | 75.66 | 74.27 |
| M | PBA | 1530 | 1000 | 73.54 | 73.23 |
| N | PBA | 1680 | 1100 | none | 70.50 |
| O | None | 1680 | 1050 | 73.62 | 75.49 |
| P | PBA | 1680 | 1050 | 78.34 | 77.68 |
| Q | None | 1680 | 1420 | 72.39 | 72.98 |
| R | None | 1530 | 1200 | 77.05 | 77.05 |
| S | None | 1720 | 1300 | 69.48 | 72.04 |
| T | None | 1490 | 1000 | 74.29 | 74.29 |

While not wanting to be bound by theory, the following discusses factors which are believed to result in unexpectedly good magnetic properties in the process of the present invention while using ferrite hot rolling, no hot band annealing and lower coiling temperatures. Contrary to conventional understanding, the present invention achieves good magnetic properties without a hot band anneal using coiling temperatures that are so low that self annealing is not believed to be a significant factor. The ability to achieve good magnetic properties using low coiling temperatures is not fully understood.

It is believed that low reheat temperatures are a factor in achieving the good magnetic properties. The low reheat temperatures are believed to precipitate more of magnetically harmful AlN and MnS from the steel and to encourage particle coarsening of these compounds. Coarse distributions of AlN and MnS precipitates are less harmful to the magnetic properties. Another advantage of using low reheat temperatures is that it enhances productivity of ferrite finished materials at the hot strip mill. Less water is needed to cool the steel between stands during hot rolling if the slabs are reheated to low temperatures initially.

Many modifications and variations of the invention will be apparent to those skilled in the art from the foregoing detailed description. Therefore, it is to be understood that, within the scope of the appended claims, the invention can be practiced otherwise than as specifically disclosed.

What is claimed is:

1. A method of making electrical steel strip characterized by low core loss and high permeability comprising the steps of:

producing a slab having a composition consisting essentially of (% by weight):

C: up to 0.02
Si: 0.20–1.35
Al: 0.10–0.45
Mn: 0.10–1.0
S: up to 0.015
N: up to 0.006
Sb: up to 0.07
Sn: up to 0.12, and
the balance being substantially iron, hot rolling the slab into a strip with a finishing temperature in the ferrite region, coiling the strip at a temperature not greater than 1050° F. such that substantially no self-annealing occurs, cold rolling the strip which has not been subjected to an annealing operation after the coiling, batch annealing the strip, and temper rolling the strip.

2. The method according to claim 1 comprising coiling the strip at a temperature not greater than 1000° F.

3. The method according to claim 1 wherein said temper rolling is effective to reduce the thickness of the strip by an amount ranging from about 3% to about 10%.

4. The method according to claim 1 wherein the coiling temperature is effective to produce a strip cleanliness of at least about 70.0% light transmission through tape.

5. The method according to claim 1 wherein the coiling temperature is effective to produce a strip cleanliness of at least about 74.0% light transmission through tape.

6. The method according to claim 1 comprising annealing after said temper rolling.

7. The method according to claim 1 comprising reheating the slab to a temperature ranging from 2100 to 2300° F. prior to said hot rolling.

8. A method of making electrical steel strip characterized by low core loss and high permeability comprising the steps of:

producing a slab having a composition consisting essentially of (% by weight):

C: up to 0.02
Si: 0.20–1.35
Al: 0.10–0.45
Mn: 0.10–1.0
S: up to 0.015
N: up to 0.006
Sb: up to 0.07
Sn: up to 0.12, and
the balance being substantially iron, hot rolling the slab into a strip with a finishing temperature in the ferrite region, coiling the strip at a temperature not greater than 1000° F., cold rolling the strip which has not been subjected to an annealing operation after the coiling, batch annealing the strip, and temper rolling effective to reduce the thickness of the strip by an amount ranging from about 3% to about 10%.

9. The method according to claim 8 wherein the coiling temperature is effective to produce a strip cleanliness of at least about 70.0% light transmission through tape.

10. The method according to claim 8 wherein the coiling temperature is effective to produce a strip cleanliness of at least about 74.0% light transmission through tape.

11. The method according to claim 8 comprising annealing after said temper rolling.

12. The method according to claim 8 comprising reheating the slab to a temperature ranging from 2100 to 2300° F. prior to said hot rolling.

13. A method of making electrical steel strip characterized by low core loss and high permeability comprising the steps of:

producing a slab having an electrical steel composition, hot rolling the slab into a strip with a finishing temperature in the ferrite region, coiling the strip at a temperature not greater than 1050° F. such that substantially no self-annealing occurs, cold rolling the strip which has not been subjected to an annealing operation after the coiling, batch annealing the strip, and temper rolling the strip.

14. The method according to claim 13 comprising coiling the strip at a temperature not greater than 1000° F.

15. The method according to claim 13 wherein said temper rolling reduces the thickness of the strip by an amount ranging from about 3% to about 10%.

16. The method according to claim 13 wherein the coiling temperature is effective to produce a strip cleanliness of at least about 70% light transmission through tape.

17. The method according to claim 13 comprising reheating the slab to a temperature ranging from about 2100 to 2300° F. prior to said hot rolling.

18. The method according to claim 13 wherein said composition comprises up to 0.024% C by weight and up to 1.35% Si by weight.

19. The composition of claim 18 further comprising 0.10–0.45% Al by weight.

20. A method of making electrical steel strip characterized by low core loss and high permeability while avoiding hot rolling mill problems, comprising the steps of:

evaluating an extent by which amounts of C, Si and Al raise or lower at least one phase transition temperature of an electrical steel composition during hot rolling, the at least one said phase transition temperature being at least one of a temperature at a transition between a single-phase ferrite region and a two-phase ferrite/austenite region and a temperature at a transition between the two-phase ferrite/austenite region and a single-phase austenite region;

selecting a ferrite hot roll finishing temperature for said electrical steel composition based upon said evaluation, said ferrite hot roll finishing temperature being below the at least one said phase transition temperature and in said single-phase ferrite region;

producing a slab of said electrical steel composition;

hot rolling the slab into a strip at said ferrite hot roll finishing temperature;

coiling the strip at a temperature less than 1200° F. such that substantially no self-annealing occurs;

cold rolling the strip which has not been subjected to an annealing operation after the coiling;

batch annealing the strip; and temper rolling the strip.

21. The method according to claim 20 comprising coiling the strip at a temperature not greater than 1050° F.

22. The method according to claim 20 comprising coiling the strip at a temperature not greater than 1000° F.

23. The method of claim 13 wherein said temper rolling is effective to reduce the thickness of the strip by an amount ranging from about 3% to about 10%.

24. The method of claim 20 wherein said temper rolling is effective to reduce the thickness of the strip by an amount ranging from about 3% to about 10%.

* * * * *